US006319081B1

(12) United States Patent
Davis

(10) Patent No.: US 6,319,081 B1
(45) Date of Patent: Nov. 20, 2001

(54) MARINE PROPULSION APPARATUS WITH A HEAT SHIELD TO PROTECT ITS SEALS

(75) Inventor: Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/379,926

(22) Filed: Aug. 24, 1999

(51) Int. Cl.[7] ..... B63H 23/36
(52) U.S. Cl. ..... 440/112; 440/83
(58) Field of Search ..... 440/38, 49, 78, 440/89, 83, 112; 277/549, 551, 562, 565, 572; 416/93 A, 93 R, 146 A

(56) References Cited

U.S. PATENT DOCUMENTS

| | | | | |
|---|---|---|---|---|
| 3,214,179 | * | 10/1965 | Dega | 277/309 |
| 3,246,698 | | 4/1966 | Kiekhaefer . | |
| 3,348,851 | * | 10/1967 | Symons et al. | 277/559 |
| 3,356,151 | | 12/1967 | Strang . | |
| 3,619,083 | | 11/1971 | Witte . | |
| 3,748,061 | | 7/1973 | Henrich . | |
| 3,854,732 | * | 12/1974 | Franz et al. | 277/563 |
| 3,871,324 | | 3/1975 | Snyder . | |
| 3,943,790 | | 3/1976 | Meyer . | |
| 4,359,228 | * | 11/1982 | Cather | 277/550 |
| 4,373,922 | | 2/1983 | Weed . | |
| 4,388,070 | | 6/1983 | Kasschau . | |
| 4,511,339 | | 4/1985 | Kasschau . | |
| 4,946,410 | * | 8/1990 | Haman | 440/83 |
| 5,503,404 | * | 4/1996 | Newton et al. | 277/551 |
| 5,522,703 | | 6/1996 | Okamoto . | |
| 5,527,195 | | 6/1996 | Neisen . | |
| 5,803,611 | * | 9/1998 | Newton et al. | 384/97 |
| 5,816,869 | | 10/1998 | Willows . | |
| 5,911,607 | * | 6/1999 | Lacko et al. | 440/83 |

FOREIGN PATENT DOCUMENTS

| | | | | |
|---|---|---|---|---|
| 218424 A1 | * | 2/1985 | (DE) | 277/549 |
| 1389832 A | * | 4/1975 | (GB) | 277/549 |

* cited by examiner

*Primary Examiner*—S. Joseph Morano
*Assistant Examiner*—Ajay Vasudeva
(74) *Attorney, Agent, or Firm*—William D. Lanyi

(57) ABSTRACT

A sealing member for a propeller shaft is provided with a heat shield to prevent damage from occurring to an elastomeric portion of the sealing member when exposed to hot exhaust gases. The exhaust gases can flow in thermal communication with the elastomeric portion of the sealing member when the marine propulsion unit is operated in reverse gear. A heat shield is provided by extending a metallic portion of the sealing structure toward the outer cylindrical surface of the propeller shaft and rounding the edge to avoid direct contact between the heat shield and the propeller shaft.

20 Claims, 7 Drawing Sheets

MARINE PROPULSION APPARATUS WITH A HEAT SHIELD TO PROTECT ITS SEALS

BACKGROUND OF THE INVENTION

1. Field of the Invention

The present invention is generally related to marine propulsion systems and, more specifically, to a heat shield provided for an elastomeric sealing component to prevent heat damage from being caused to the elastomeric component by a exhaust gases.

2. Description of the Prior Art

Many different types of marine propulsion systems are well known to those skilled in the art, including outboard motors and stern drive units. In certain types of marine propulsion systems, exhaust gases from an internal combustion engine are routed through a propeller hub of the propulsion system. It is also generally known to those skilled in the art that elastomeric seals are particularly advantageous for sealing a lubrication compartment from the water in which the propulsion system is operated. It is also known to those skilled in the art that certain devices, such as fishline cutters can be provided within a propeller hub or near the elastomeric seals.

U.S. Pat. No. 3,619,083, which issued to Witte on Nov. 9, 1971, discloses a cutter which is mounted on the inner end of the propeller hub of an outboard marine propulsion unit for the purpose of cutting fishlines which become entangled upon the propeller. The fishline cutter also protects the gear case seal from damage by the fishline.

U.S. Pat. No. 3,871,324, which issued to Snyder on Mar. 18, 1975, discloses an outdoor propulsion unit exhaust discharge system. The system is used with an engine driven outboard propulsion unit having a reversible propeller in order to selectively drive the propulsion unit in forward and reverse directions. The device also comprises passage means for conducting the exhaust gases from the engine through the unit. The pair of underwater discharge openings for the propulsion unit are provided and respectively disposed fore and aft of the propeller to provide for selective exhaust discharge into the outflow of the propeller slipstream regardless of the direction of propulsion unit operation. This assures a solid flow of water to the propeller in both forward and reverse directions of operation of the propulsion unit.

U.S. Pat. No. 3,943,790, which issued to Meyer on Mar. 16, 1976, describes a marine outboard gear assembly. The invention includes a marine outboard gear assembly which is usable in an outboard motor or an inboard-outboard drive. It features a constant drive of the meshing gears which transfer power to the propeller shaft axis and selective spring-clutching direct to the propeller shaft. It utilizes the meshing gears for lubricant circulation as long as the engine is operating and whether or not the clutch is engaged. It also reduces to an absolute minimum the drag and inertial effects operative upon the propeller shaft when the boat is moving in the declutched condition, such as when the propeller is windmilling. Also shown in this patent is a particular subassembly of gear and clutch parts on the propeller shaft whereby desired axial clearance can be readily pre-adjusted and selected, prior to assembly of the gear case.

U.S. Pat. No. 3,356,151, which issued to Strang on Dec. 5, 1967, discloses a marine propeller which includes a hub that is adapted for rearwardly discharging exhaust gases and which has, at the rearward end thereof, an annular ring located in adjacently outwardly spaced relation to the propeller hub and cooperating with the propeller hub to provide one or more passageways serving to deflect water flowing rearwardly about the hub into the exhaust gas stream.

U.S. Pat. No. 5,522,703, which issued to Okamoto on Jun. 4, 1996, describes a propulsion system for an outboard drive. The system includes a seal between adjacent ends of a pair of counter-rotating propellers. The seal inhibits fluid flow through a joint between the propellers, while minimizing frictional contact between the counter-rotating propellers. In at least one embodiment, the seal contacts only one of the propellers.

U.S. Pat. No. 3,748,061, which issued to Henrich on Jul. 24, 1973, describes a propeller construction. The propeller includes a bushing part adapted to be mounted on a propeller shaft for common rotary movement of the bushing part with a propeller shaft. A resilient member is bonded to the outer periphery of the bushing and has an outer non-circular configuration including a series of alternate areas of greater and lesser radial distance from the axis of the bushing and a propeller blade part having a hub including a bore with an inner configuration including a series of alternate areas of greater and lesser radial distance from the axis of the propeller and detachably receiving the resilient member.

U.S. Pat. No. 3,246,698, which issued to Kiekhaefer on Apr. 19, 1966, discloses a diffuser-pump for marine propulsion propeller hub exhaust systems. The invention is based on an improvement in known prior structures and generally contemplates the utilization of a removable replaceable combined diffuser-pump member at the extreme discharge end of the hub. More specifically, the member is secured for rotation with the outer end of the propeller shaft and includes radial veins integral with a flared diffuser ring which act in combination to pump water from the hub.

U.S. Pat. No. 5,527,195, which issued to Neisen on Jun. 18, 1996, discloses a flow through marine propeller. The propeller has an integral aft skirt portion with a plurality of slots extending forwardly from the trailing end and dividing the skirt portion into a plurality of circumferentially spaced segments separated from each other at the trailing end by respective slots therebetween and integrally joined to each other at the outer hub forwardly of the slots. Aft trailing blade tips of the propeller blades meet the outer hub at points offset from the slots to prevent engine exhaust in the through hub exhaust passage from seeking the negative pressure backside surfaces of the propeller blades through the slots.

U.S. Pat. No. 5,816,869, which issued to Willows, on Oct. 6, 1998, discloses a propeller for varying the exhaust length. The marine propulsion system provides variable length exhaust paths depending upon the speed of the boat and motor. The propeller includes a propeller hub and an exhaust tube positioned within the propeller hub. The exhaust tube extends past the aft end of the propeller hub and defines a first exhaust passageway. A second exhaust passageway is positioned between the propeller hub and the exhaust tube. The second exhaust passageway is shorter than the first exhaust passageway. At low speeds, engine exhaust exits the longer first passageway, while at moderate speeds, engine exhaust exits the shorter second passageway. As a result, the effective length of the exhaust path varies depending upon the speed of the motor, such that the length of the exhaust path is specifically tuned to several speeds of the motor.

U.S. Pat. No. 4,373,922, which issued to Weed on Feb. 15, 1983, discloses an outboard propulsion gear case. The outboard drive unit for a watercraft has a through-the-propeller hub exhaust system for engine exhaust and has a bearing support member which carries the propeller shaft and separates the exhaust passages from the propeller shaft gears. Lubricant retaining surfaces are formed on the bearing support member to prevent corrosion between the support members and the housing.

U.S. Pat. No. 4,388,070, which issued to Kasschau on Jun. 14, 1983, describes a propeller exhaust hub and shroud. The propeller is intended for controlling the discharge of gases and cooling water exhausting from the central hub of an outboard motor unit comprising a cylindrical shroud surrounding the propeller hub to confine the exhaust to the innermost part of the blades and discharging it downstream of the propeller when operating the unit in the forward or reverse mode. Several attachments to the shroud which enhance the discharge performance of the propeller are also described. An alternate embodiment of this device comprises a shroud which can be attached to a conventional through-hub marine propulsion device to channel the exhaust away from the propeller area.

U.S. Pat. No. 4,511,339, which issued to Kasschau on Apr. 16, 1985, describes an exhaust propeller assembly. The propeller is used for controlling the discharge of engine exhaust gases from the central hub of a boating motor unit by making provision for confining the gases to the inner most fraction of the structure and discharging it downstream of the propeller when operating the unit in either the forward or astern mode of operation.

In marine propulsion systems that provide for the passage of engine exhaust through or near the propeller, hot exhaust gases can possibly be drawn into heat sensitive regions of the unit when the propulsion system is operated. More specifically, hot engine exhaust gases can be drawn back into the propeller hub and, eventually, in thermal communication with elastomeric fields that are used to contain lubrication fluids within the gear case. The heat from the exhaust gases can cause severe damage to the elastomeric portions of the seals. It would therefore be significantly beneficial if a means could be provided for protecting the heat sensitive materials used in the sealing components of marine propulsion systems under these potential damaging conditions.

SUMMARY OF THE INVENTION

The present invention provides a means for protecting heat sensitive materials, such as elastomeric materials, from damage due to the temperatures of exhaust gases flowing in thermal communication with the elastomeric materials. A marine propulsion apparatus made in accordance with the preferred embodiment of the present invention comprises a housing and a propeller shaft rotatably supported within the housing. The propeller shaft is rotatably supported about a centerline within the housing and extends rearwardly from the housing when the propulsion apparatus is operated to move a watercraft in a forward direction. The propeller shaft is shaped to receive a propeller in attachment thereto. A sealing device is supported in stationary relation with the housing and has an elastomeric portion. The elastomeric portion has a sealing surface disposed in close proximity with an external cylindrical surface of the propeller shaft.

A particularly preferred embodiment of the present invention further comprises a heat shield that is attached to the sealing device and disposed between the elastomeric portion and a rearwardly distal end of the propeller shaft. The heat shield has a generally circular edge surrounding the external cylindrical surface of the propeller shaft. The generally circular edge is spaced apart from the external cylindrical surface of the propeller shaft by a gap which is preselected to avoid contact between the heat shield and the propeller shaft when the propeller shaft deviates from the centerline of the propeller shaft by its maximum possible magnitude. In a particularly preferred embodiment of the present invention, the gap is between 0.010 inches and 0.050 inches but, in alternative embodiments of the present invention, the gap can be between 0.025 inches and 0.035 inches. The function of the gap is to be large enough to avoid contact between the heat shield and the propeller shaft during normal operation of the propulsion system and be small enough to effectively provide a heat barrier to prevent exhaust gases from damaging the elastomeric portion of the sealing device.

In a preferred embodiment of the present invention, the heat shield is metal. The generally circular edge can be formed in at least two possible ways. One, the heat shield can be folded over on itself to form a two-ply structure having a rounded edge at its most radially inward portion. Alternatively, the generally circular edge can be a rounded edge of a single-ply structure. The propulsion apparatus can be an outboard motor or a stern drive unit. In one particularly preferred embodiment of the present invention, the heat shield comprises an angular plate portion which extends radially inward toward the generally circular edge surrounding the external cylindrical surface of the propeller shaft.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
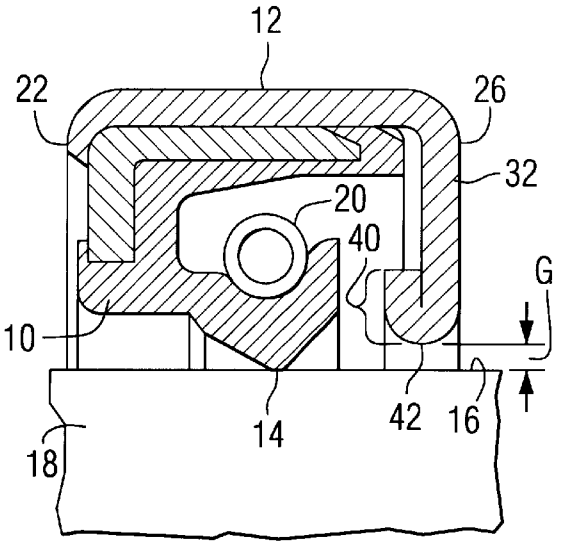
FIG. 2 shows a sealing component modified according to the present invention.

Throughout the description of the preferred embodiment of the present invention, like components will be identified by like reference numerals.

Throughout the description of the present invention, it will be described in relation to a "propeller shaft". However, it should be understood that the present invention could also be applied to a jet drive system that uses an impeller. Therefore, wherever the term "propeller" is used throughout the description and claims of the present invention, it shall mean either a propeller or an impeller. Similarly, the present invention can be used in conjunction with an outboard motor, a stern drive system, or a jet pump propulsion system.

Figure 1B:
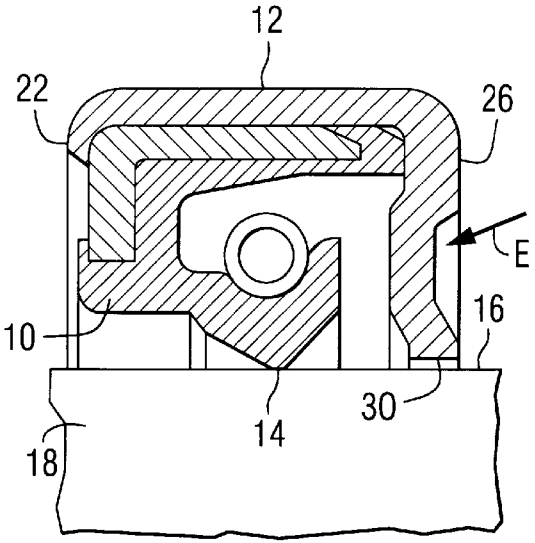
FIG. 1B PRIOR ART
FIGS. 1A and 1B show sealing components known in the prior art.
Figure 1A:
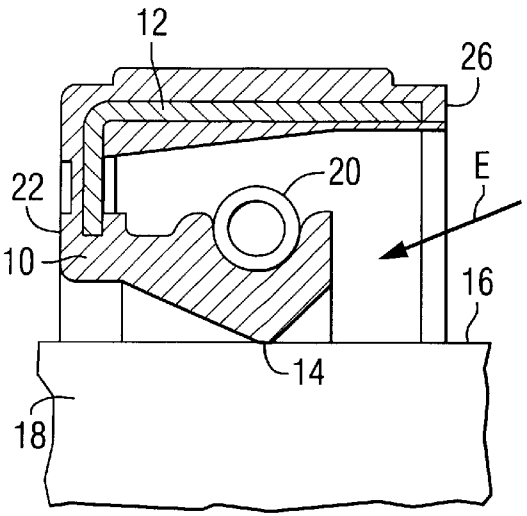
FIG. 1A PRIOR ART

FIGS. 1A and 1B show two known configurations of sealing mechanisms for marine propulsion systems. In FIG. 1A, an elastomeric component 10 is attached to a rigid support device 12. The elastomeric component 10 has a sealing surface 14 that is placed in close proximity to an external cylindrical surface 16 of a propeller shaft 18. Only a portion of the propeller shaft 18 is shown in FIGS. 1A and 1B. A spring member 20 is used to maintain a radially inward force on the elastomeric portion 10 to assure good sealing contact between the sealing surface 14 and the outer cylindrical surface 16 of the propeller shaft 18. In FIGS. 1A and 1B, the left portion 22 of the sealing device faces toward the driving gears which rotate the propeller shaft 18 while the right portion 26 of the sealing component faces the distal end of the propeller shaft 18 and the propeller which is attached to the propeller shaft. Arrow E in FIG. 1A represents the direction in which exhaust gases can possibly travel from the aft portion of a propeller hub toward the elastomeric member 10 under certain operating conditions of a watercraft.

FIG. 1B shows a known type of sealing component which is modified for the purpose of operating as a fishline cutter. In order to operate as a fishline cutter, a sharp edge 30 of an extension 32 of the rigid member 12 is allowed to extend to a position very close to the outer cylindrical surface 16 of the propeller shaft 18. The sharp edge 30 is located at the aft side of the sealing component so that a fishing line that inadvertently gets wrapped around the propeller or the propeller shaft 18 will be cut by the edge 30 before it has an opportunity to damage the elastomeric member 10 or its sealing surface 14. In FIG. 1B, arrow E represents the direction from which exhaust gases will flow under certain operating conditions of the watercraft.

FIG. 2 shows a preferred embodiment of the present invention. It is generally similar to the sealing devices described above in conjunction with FIGS. 1A and 1B, but differs from those components in a critical way which serves the valuable purpose of protecting the elastomeric member 10 from the exhaust gases while also protecting the outer cylindrical surface 16 from damage that could otherwise be caused by the edge 30 shown in FIG. 1B. The extension 32 of the support member 12 is folded over on itself to form a two-ply region 40 with a rounded edge 42. The rounded edge 42 is spaced apart from the outer cylindrical surface 16 of the propeller shaft 18 by a preselected gap G. The magnitude of gap G will be described below in greater detail.

Figure 3A:
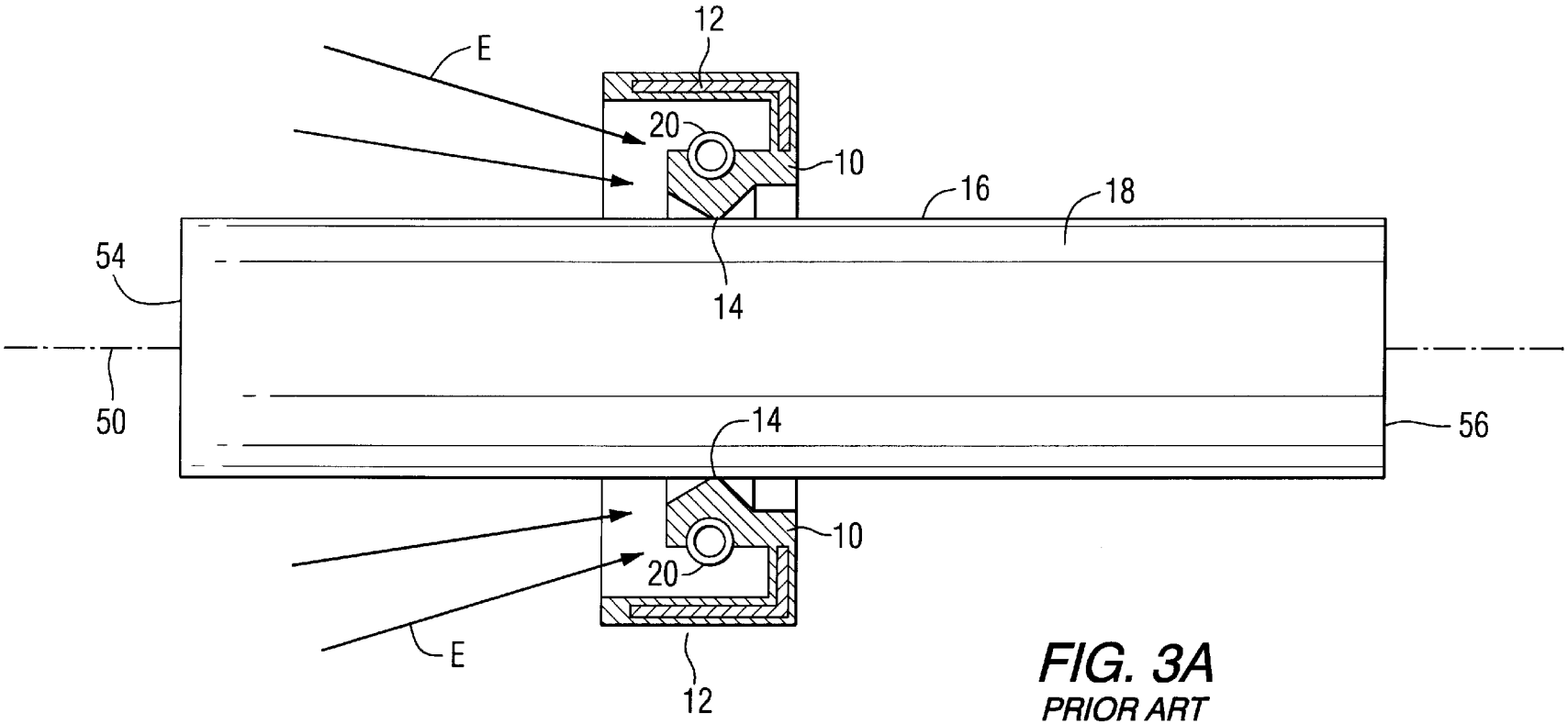
FIG. 3A PRIOR ART
FIGS. 3A and 3B show the sealing components of FIGS. 1A and 1B in conjunction with a propeller shaft.

FIG. 3A shows a sealing component, similar to the one described above in conjunction with FIG. 1A, disposed around the propeller shaft 18. The propeller shaft 18 rotates about a centerline 50. A distal end of the propeller shaft 54 extends away from the housing of the propulsion system. The other end 56 of the propeller shaft 18 is typically connected in torque transmitting relation with a driveshaft from an internal combustion engine in a manner that is well known to those skilled in the art. The sealing surface 14 of the elastomeric member 10 is held in intimate contact with the outer cylindrical surface 16 of the propeller shaft 18 by the force provided by spring member 20. Arrows E represent the direction in which hot exhaust gases can flow toward the elastomeric member 10 under certain operating conditions of the marine propulsion system such as operating it in reverse gear. When the hot gases flow toward the elastomeric member 10, the heat of the exhaust can damage the elastomeric material.

Figure 3B:
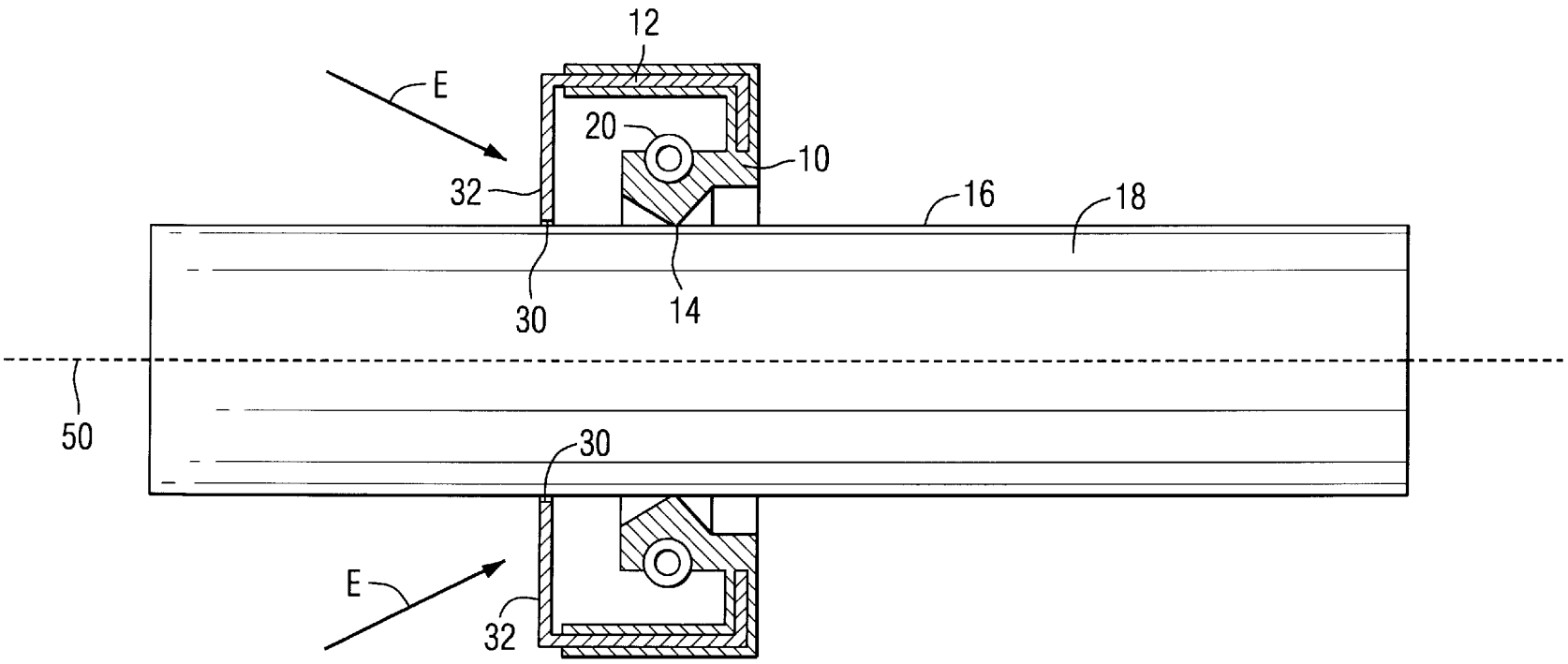
FIG. 3B PRIOR ART
Figure 4:
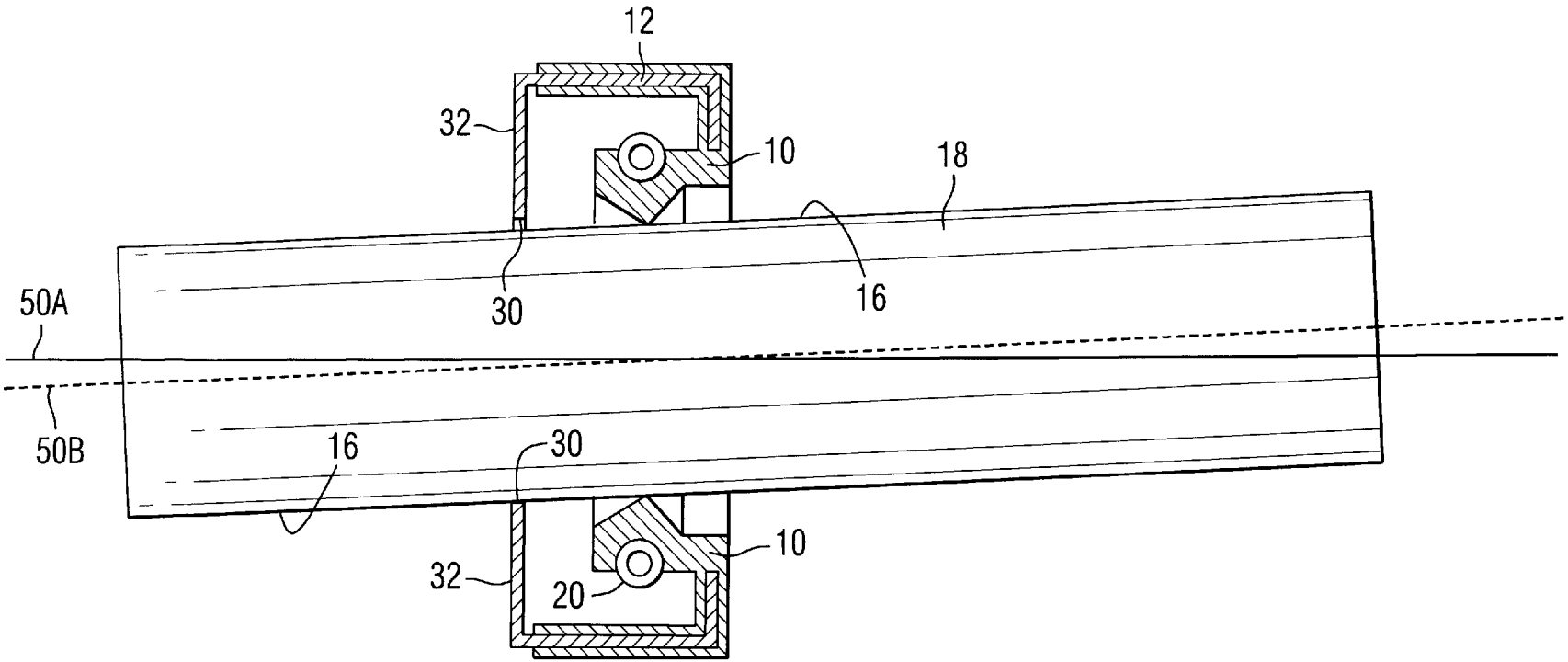
FIG. 4 PRIOR ART
FIG. 4 illustrates a disadvantage of the prior art.

FIG. 3B shows the fishline cutter type of sealing mechanism that was described above in conjunction with FIG. 1B. It provides protection from the exhaust gases E, but can cause severe damage to the cylindrical surface 16 of the propeller shaft 18 under certain operating conditions. For example, FIG. 4 shows the centerline 50B deviating from its stationary position 50A. Reference numeral 50A in FIG. 4 represents the normal position of the centerline 50 as described above in conjunction with FIGS. 3A and 3B while reference numeral 50B in FIG. 4 shows a position where the centerline has deviated from its normal location. This can occur when excessive loads are placed on the propeller shaft 18. At the bottom portion of FIG. 4, the cylindrical surface 16 of the propeller shaft has moved into direct contact with the edge 30 of the extension 32. This creates a scratching or notching in the outer cylindrical surface 16 and produces a stress concentrator in the surface that can cause failure of the propeller shaft. Therefore, although the extension 32 in FIG. 4 may provide an incidental benefit by blocking some of the hot exhaust gases from contacting the elastomeric material 10, it creates a significantly disadvantageous condition when operated under certain circumstances.

Figure 5:
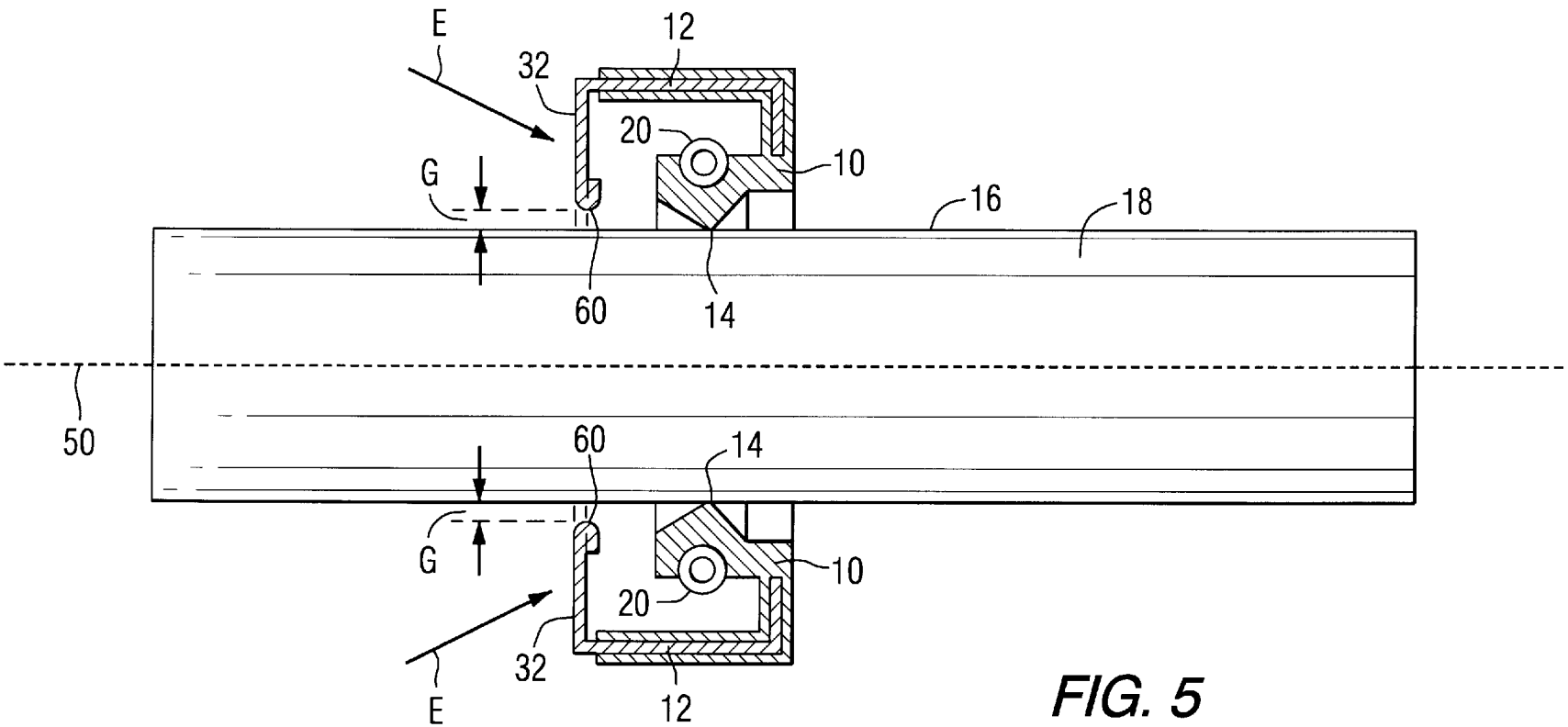
FIG. 5 shows an assembly view of the present invention in combination with a propeller shaft.

FIG. 5 shows one embodiment of the present invention in which the edge 60 of the extension 32 is intentional spaced apart from the outer cylindrical surface 16 of the propeller shaft 18 by a distance which prevents contact between the edge 60 and the propeller shaft 18 under all normal operating conditions of the marine propulsion system. The edge 60 is rounded and spaced apart from the outer cylindrical surface 16 of the propeller shaft 18. The exhaust gases E are prevented from contacting the elastomeric member 10 while the potential scratching or grooving of the outer cylindrical surface 16 is avoided.

Figure 6:
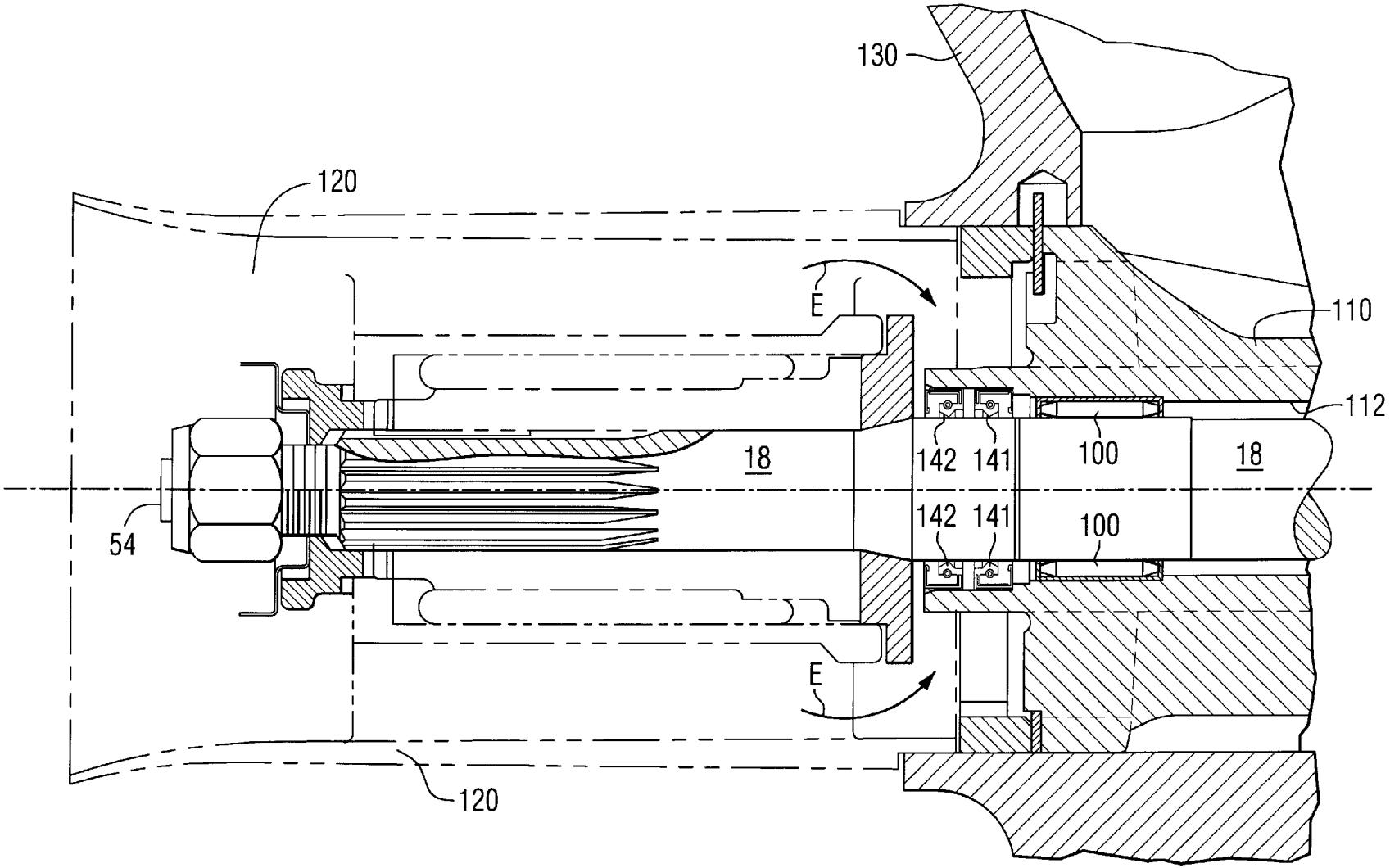
FIG. 6 shows an assembly view of a marine propulsion unit such as that in which the present invention is applicable.

It should be understood that FIGS. 3A, 3B, 4, and 5 are highly simplified illustrations of both the prior art and the present invention in association with a propeller shaft. To more clearly show an actual representation of the environment in which the present invention would be used, FIG. 6 is a portion of an assembly drawing of a propeller shaft 18 supported by bearings 100 that are, in turn, supported by a bearing carrier 110. The propeller shaft 18 extends through a central opening 112 in the bearing carrier and is supported for rotation by the bearings 100. A rearwardly distal end 54 of the propeller shaft 18 supports a propeller 120. The propeller 120 is rigidly attached to the propeller shaft 18 which, in turn, is rotatably supported by the housing 130 that supports the bearing carrier 110. In certain applications, two sealing devices, 141 and 142, are provided to maintain the lubrication greases within the bearing location of the bearing carrier and internal gears of the marine propulsion system while inhibiting water from flowing in the direction from the propeller 120 into the lubrication compartment. If two sealing devices are provided, the rear sealing device 142 would be configured in the manner described above in conjunction with the preferred embodiment of the present invention. This would prevent the hot exhaust gases E from damaging the elastomeric portion 10 of the rear sealing device. The existence of the rear sealing device 142 would, by its very nature and position, prevent hot exhaust gases from damaging the elastomeric portion 10 of the forward sealing device 141.

It should be understood that the edge 60 of the present invention can be configured as illustrated in FIG. 5 or, alternatively, as illustrated by the two-ply portion 40 in FIG. 2. The specific manner in which the rounded edge is provided is not limiting to the present invention.

In the description above, the marine propulsion apparatus of the present invention was described as comprising a housing 130 in which a propeller shaft 18 is rotatably supported about a centerline 50 within the housing 130 and extending rearwardly from the housing, as in the direction toward the left in FIG. 6, when the propulsion apparatus is operated to move a watercraft in a forward direction. The propeller shaft 18 is shaped to receive a propeller 120 in attachment thereto. The sealing device 142 is supported in stationary relation with the housing 130 and has an elastomeric portion 10. The elastomeric portion 10 has a sealing surface 14 disposed in close proximity with an external cylindrical surface 16 of the propeller shaft 18. A heat shield, such as the extension 32 shown in FIG. 5, is attached to the sealing device and disposed between the elastomeric portion 10 and the rearwardly distal end 54 of the propeller shaft 18. The heat shield 32 has a generally circular edge, 42 or 60 surrounding the external cylindrical surface 16 of the propeller shaft. The generally circular edge, 42 or 60, is spaced apart from the external cylindrical surface 16 of the propeller shaft 18 by a gap G which is preselected to avoid contact between the heat shield 32 and the propeller shaft 18 when the propeller shaft deviates from its centerline 50 from its maximum possible magnitude.

It is recognized that different propeller shafts of different marine propulsion systems will be expected to deviate from their respective stationary positions of the centerline 50 by different amounts. Certain outboard motors used in racing applications will have significant deviations because of the significant torque used in those applications. If it is expected that the propeller shaft 18 will experience significant deviation from its stationary centerline, a larger gap G should be provided to avoid scratching or grooving the external cylindrical surface 16 of the propeller shaft 18. It has been determined that a gap between 0.010 inches and 0.050 inches is advantageous in many applications. However, in other applications a much narrower gap can be used. The heat shield is typically made of metal, such as stainless steel. As described above, the rounded edge of the heat shield can be formed by folding a radially inward portion of the heat shield over on itself to form a two-ply structure having a rounded edge. Alternatively, a single ply material can be rounded for these purposes. In a particularly preferred embodiment of the present invention, the heat shield 32 comprises an annular plate portion that extends radially inward toward the generally circular edge, 42 or 60, which surrounds the external cylindrical surface 16 of the propeller shaft 18.

Figure 7A:
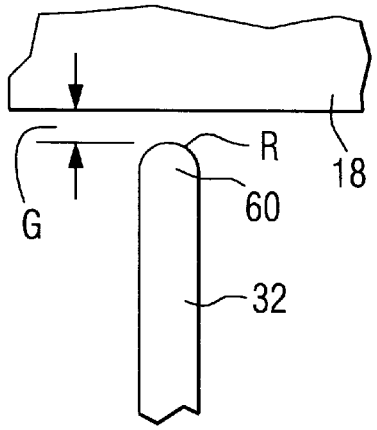
FIGS. 7A–7D show four alternative configurations of the present invention.
Figure 7B:
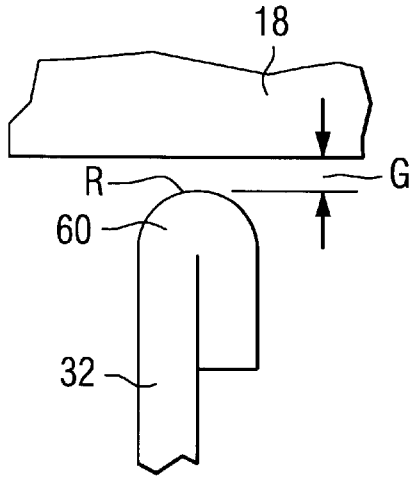
Figure 7C:
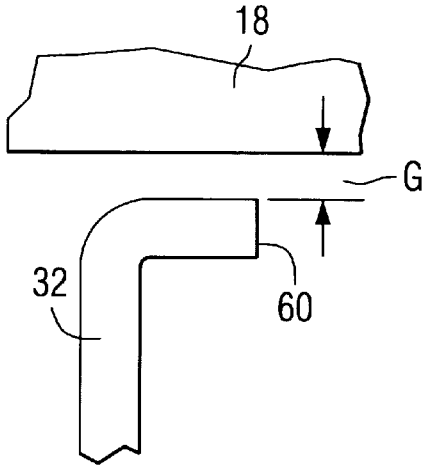
Figure 7D:
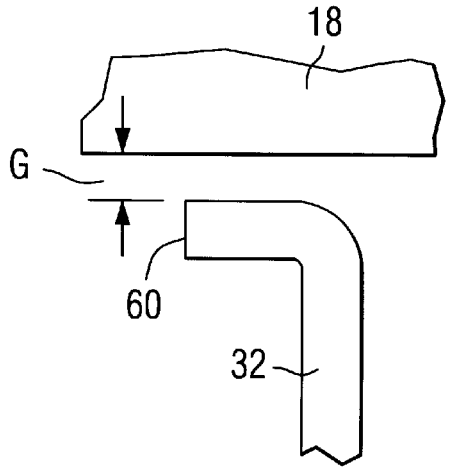

The edge 60 of the extension 32 can be configured in several different ways within the scope of the present invention. FIGS. 7A–7D show four possible configurations of the edge 60. FIG. 7A shows a simple rounded edge 60 of a single thickness of the extension 32. This results in a radius of curvature R that is generally equal to half the thickness of the extension 32. FIG. 7B shows a preferred embodiment of the present invention that results in a radius of curvature R that is generally equal to the thickness of the extension 32. FIGS. 7C and 7D show simple right angle bends of the extension 32 that results in flat surfaces facing the shaft. The edge 60 can face forward and inward or toward the stem and outward as represented in FIGS. 7C and 7D, respectively.

Although the present invention has been described to illustrate a particularly preferred embodiment, it should be understood that other alternative embodiments are also within its scope.

I claim:

1. A marine propulsion apparatus, comprising:

a housing;

a propeller shaft rotatably supported about a centerline within said housing and extending rearwardly from said housing when said propulsion apparatus is operated to move a watercraft in a forward direction, said propeller shaft being shaped to receive a propeller in attachment thereto;

a sealing device supported in stationary relation with said housing, said sealing device having an elastomeric portion, said elastomeric portion having a sealing surface disposed in close proximity with an external cylindrical surface of said propeller shaft; and a heat shield attached to said sealing device and disposed between said elastomeric portion and a rearwardly distal end of said propeller shaft, said heat shield having a generally circular edge surrounding said external cylindrical surface of said propeller shaft, said generally circular edge being spaced apart from said external cylindrical surface of said propeller shaft by a gap which is preselected to avoid contact between said heat shield and said propeller shaft when said propeller shaft deviates from said centerline by its maximum possible magnitude.

2. The apparatus of claim 1, wherein:

said gap is between 0.010 inches and 0.050 inches in radial clearance.

3. The apparatus of claim 2, wherein:

said gap is between 0.020 inches and 0.040 inches in radial clearance.

4. The apparatus of claim 3, wherein:

said gap is between 0.025 inches and 0.035 inches in radial clearance.

5. The apparatus of claim 1, wherein:

said heat shield is metal.

6. The apparatus of claim 1, wherein:

said generally circular edge is formed by folding a radially inward portion of said heat shield over on itself to form a two-ply structure having a rounded edge at its most radially inward portion.

7. The apparatus of claim 1, wherein:

said generally circular edge is rounded.

8. The apparatus of claim 1, wherein:

said generally circular edge is formed by folding a portion of said heat shield over on itself.

9. The apparatus of claim 1, wherein:

said heat shield is bent at a generally right angle to form an extension.

10. The apparatus of claim 9, wherein:

said extension extends in an aft direction.

11. The apparatus of claim 1, wherein:

said propulsion apparatus is an outboard motor.

12. The apparatus of claim 1, wherein:

said propulsion apparatus is a stern drive unit.

13. The apparatus of claim 1, wherein:

said heat shield comprises an annular plate portion extending radially inward toward said generally circular edge surrounding said external cylindrical surface of said propeller shaft.

14. A marine propulsion apparatus, comprising:

a housing;

a propeller shaft rotatably supported about a centerline within said housing and extending rearwardly from said housing when said propulsion apparatus is operated to move a watercraft in a forward direction, said propeller shaft being shaped to receive a propeller in attachment thereto;

a sealing device supported in stationary relation with said housing, said sealing device having an elastomeric portion, said elastomeric portion having a sealing surface disposed in close proximity with an external cylindrical surface of said propeller shaft; and a metal heat shield attached to said sealing device and disposed between said elastomeric portion and a rearwardly distal end of said propeller shaft, said metal heat shield having a generally circular edge surrounding said external cylindrical surface of said propeller shaft, said generally circular edge being spaced apart from said external cylindrical surface of said propeller shaft by a gap which is preselected to avoid contact between said metal heat shield and said propeller shaft when said propeller shaft deviates from said centerline by its maximum possible magnitude.

15. The apparatus of claim 14, wherein:

said generally circular edge is formed by folding a radially inward portion of said heat shield over on itself to form a two-ply structure having a rounded edge at its most radially inward portion.

16. The apparatus of claim 14 wherein:

said heat shield comprises an annular plate portion extending radially inward toward said generally circular edge surrounding said external cylindrical surface of said propeller shaft.

17. A marine propulsion apparatus, comprising:

a housing;

a propeller shaft rotatably supported about a centerline within said housing and extending rearwardly from said housing when said propulsion apparatus is operated to move a watercraft in a forward direction, said propeller shaft being shaped to receive a propeller in attachment thereto;

a sealing device supported in stationary relation with said housing, said sealing device having an elastomeric portion, said elastomeric portion having a sealing surface disposed in close proximity with an external cylindrical surface of said propeller shaft; and a metal heat shield attached to said sealing device and disposed between said elastomeric portion and a rearwardly distal end of said propeller shaft, said metal heat shield having a generally circular edge surrounding said external cylindrical surface of said propeller shaft, said generally circular edge being spaced apart from said external cylindrical surface of said propeller shaft by a gap which is preselected to avoid contact between said metal heat shield and said propeller shaft when said propeller shaft deviates from said centerline by its maximum possible magnitude, said gap being between 0.010 inches and 0.050 inches in radial clearance.

18. The apparatus of claim 17, wherein:

said heat shield comprises an annular plate portion extending radially inward toward said generally circular edge surrounding said external cylindrical surface of said propeller shaft.

19. The apparatus of claim 18, wherein:

said generally circular edge is formed by folding a radially inward portion of said heat shield over on itself to form a two-ply structure having a rounded edge at its most radially inward portion.

20. The apparatus of claim 17, wherein:

said generally circular edge is rounded.

* * * * *